United States Patent [19]

Lester et al.

[11] Patent Number: 4,507,941

[45] Date of Patent: Apr. 2, 1985

[54] SOLID SUBLIMING COOLER WITH RADIATIVELY-COOLED VENT LINE

[75] Inventors: James M. Lester, Boulder; Richard P. Reinker, Arvada; Douglas E. Regenbrecht, Boulder, all of Colo.

[73] Assignee: Ball Corporation, Muncie, Ind.

[21] Appl. No.: 487,692

[22] Filed: Apr. 22, 1983

[51] Int. Cl.[3] ..... F25B 19/00

[52] U.S. Cl. ..... 62/514 R; 62/264; 62/467; 62/384

[58] Field of Search ..... 62/264, 467 R, 384, 62/385, 514 R

[56] References Cited

U.S. PATENT DOCUMENTS

| | | | |
|---|---|---|---|
| 2,502,588 | 4/1950 | Preston et al. | 62/50 |
| 2,512,916 | 6/1950 | Brown | 62/385 |
| 3,253,423 | 5/1966 | Sonnabend | 62/467 R |
| 3,422,886 | 1/1969 | Buller | 62/467 R |
| 3,545,226 | 12/1970 | Newell | 62/384 |
| 3,979,325 | 9/1976 | Ceccaldi et al. | 62/467 R |
| 4,030,316 | 6/1977 | Aronson | 62/467 R |

*Primary Examiner*—Ronald C. Capossela

*Attorney, Agent, or Firm*—Gilbert E. Alberding

[57] ABSTRACT

The vent line of a space-borne solid subliming cooler is formed to provide a heat radiator which radiates much of the heat losses otherwise parasitically conducted back to the cooler thereby permitting the use of certain high heat capacity cryogens at operating and working temperatures requiring very low operating vapor pressures but without as much parasitic heat conduction loss as is associated with conventionally vented solid subliming coolers.

20 Claims, 6 Drawing Figures

Figure 1:
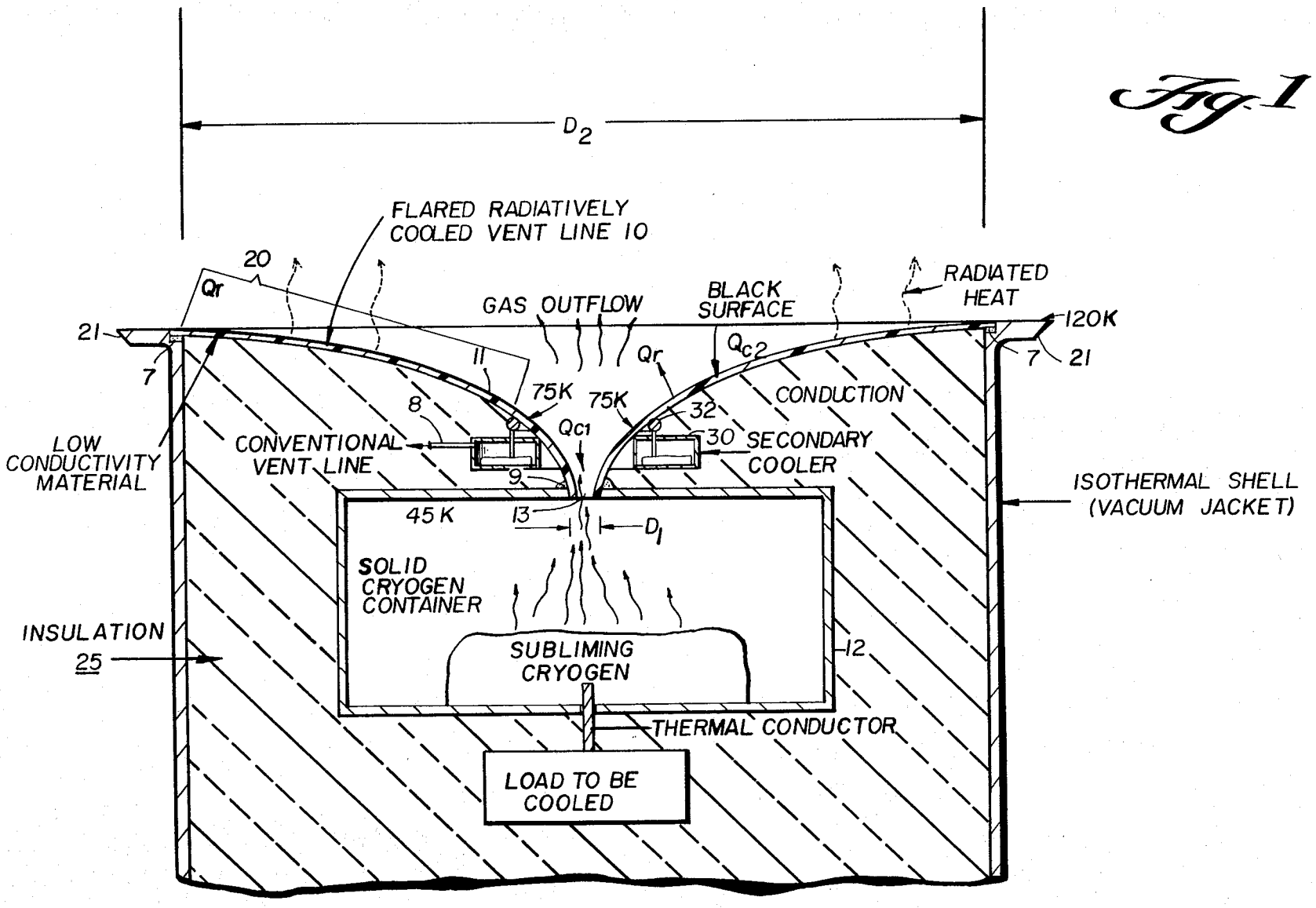
Figure 2:
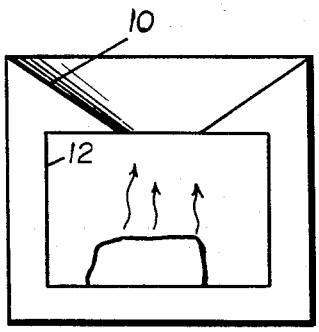

ISOTHERMAL SHELL (VACUUM JACKET)
120K
21
7
RADIATED HEAT
CONDUCTION
BLACK SURFACE
$Q_{c2}$
SECONDARY COOLER
30
32
12
THERMAL CONDUCTOR
$Q_r$
$D_1$
GAS OUTFLOW
75K
$Q_{c1}$
SUBLIMING CRYOGEN
LOAD TO BE COOLED
$D_2$
FLARED RADIATIVELY COOLED VENT LINE 10
75K
9
13
11
8
45 K
SOLID CRYOGEN CONTAINER
CONVENTIONAL VENT LINE
20
$Q_r$
7
21
LOW CONDUCTIVITY MATERIAL
INSULATION 25

CONE

PARABOLA

SPHERICAL DISH

TORUS

FLAT PLATE

SOLID SUBLIMING COOLER WITH RADIATIVELY-COOLED VENT LINE

The present invention relates to solid subliming coolers and, more particularly, to a solid subliming cooler having a new radiatively-cooled vent line. Such coolers may be used, for example, in cryogenic coolant systems for space vehicles and/or other space borne apparatus.

The vent line arrangement according to the invention radiates parasitic heat losses otherwise conducted through the vent line to the cryogen coolant and, by so doing, it permits the practical and thermally efficient use of cryogens (e.g. such as methane) at very low working temperatures which require corresponding extremely low operating vapor pressures. Such use of high heat capacity coolants at lower than usual operating temperatures results in substantial reductions in the required mass of cryogen for a given cooling mission and in overall cooler size and weight as compared to conventional cooling devices.

Although it is known that the vapor produced from solid subliming cryogens (coolants) must be vented through plumbing to maintain a desired system temperature (i.e. to maintain a desired operating point on a cryogen temperature versus vapor pressure curve), certain coolants have not heretofore often been considered acceptable in such systems because of the high heat input associated with conventional venting arrangements.

For example, a comparison of the required mass and volume of cryogens necessary in a typical application might lead one initially to believe that methane would be a preferred choice for an efficient and practical cooling medium. However, if methane is used to maintain low working temperatures (e.g. below 50K), it becomes necessary to maintain an extremely low vapor pressure (generally in the range of $10^{-3}$ Torr and below). This, in turn, requires that the vent tube connected to the cryogen container for venting the vapor evolved during the sublimation process as the latent heat of sublimation is absorbed must be very large in diameter. A large diameter vent tube in a typical prior art arrangement necessarily implies corresponding large parasitic heat conduction back into the cryogenic container through the walls of the vent tube itself. In the case of methane, once the parasitic heat loss problem is fully accounted for, the methane usually cannot be used efficiently because an excessive amount must be consumed simply to satisfy the conductive parasitic heat leak through the vent tube.

In this regard, depicted below in Table 1 is a listing of the theoretical required weight and storage volume of four solid coolants for a five-year cooling load of 150 milliwatts at 50K (without yet taking into account parasitic heat losses). All such materials are candidates because the evolved vapor can be readily vented through plumbing while maintaining the desired temperature (i.e. the desired operating point on the temperature versus vapor pressure curves).

TABLE 1

| Coolant | Requirements for Five Candidate Coolants (5 Year Baseline Mission) Coolant Mass[1] kg (lb) | Coolant Volume[2] l ($ft^3$) | Tank Size[3] -cm (in) |
|---|---|---|---|
| Neon | 233 (491) | 156 (5.5) | 58 (22.9) |
| Argon | 120 (265) | 74 (2.6) | 45 (17.9) |

TABLE 1-continued

| Coolant | Requirements for Five Candidate Coolants (5 Year Baseline Mission) Coolant Mass[1] kg (lb) | Coolant Volume[2] l ($ft^3$) | Tank Size[3] -cm (in) |
|---|---|---|---|
| Nitrogen | 98 (215) | 102 (3.6) | 51 (19.9) |
| Hydrogen[4] | 25 (56) | 283 (10.0) | 71 (28.0) |
| Methane | 41 (90) | 82 (2.9) | 47 (18.5) |

Notes:
[1]The mass of coolant needed to absorb 150 milliwatts at 50K for five years.
[2]The volume needed to store the coolant mass.
[3]The diameter of the tank cylinder whose length is equal to its diameter.
[4]The heat capacity of vented hydrogen gas is also used to cool the load.

The vapor pressure of the coolant must, of course, be sufficiently high to allow venting at the desired temperature through a reasonably-sized vent pipe. If the required vapor pressure is too low, the vent pipe must be so large in diameter that the conductive parasitic heat leak through the vent pipe itself becomes unacceptably high, and the total weight of the coolant needed to offset the leak as well as to cool the desired load may make the system impractical. Thus, in a conventional "tube type" vent system, the fifth entry in Table 1 (methane) would typically be eliminated as a practical coolant. That is, the vapor pressure of methane at 50K is only about $2\times10^{-3}$ Torr, thereby requiring an unacceptably large vent pipe. If methane could otherwise be used, it would result in the lightest total system because the cryogen tank volume would be relatively small and the empty tank mass would be lower than for a system utilizing hydrogen.

A methane system would be superior to hydrogen in another important practical aspect. Hydrogen must be stored at a temperature far below the desired cooling temperature, (less than 14K) to maintain it in solid form for zero gravity coolant retention. A system utilizing the 56 pound hydrogen mass shown in Table 1 must take full advantage of the heat capacity of the gas between its subliming temperature of 10K and the load temperature of 50K. The temperature rise contributes almost 50% of the available cooling capacity but it is not entirely useable. Thus, in order to ensure that the proper load temperature is achieved, a "feedback" control loop and an active heater must be employed. This practical requirement reduces reliability and necessarily makes the above-noted 56 pound hydrogen mass only a minimum value. The prescribed mass could, in fact, nearly double depending on the variability of the thermal loads on the cooler.

Systems which do not rely on the cooling capacity available in the vented gas itself to cool the load are more inherently stable because of the stable relationship between cryogen temperature and subliming vapor pressure for a given heat load. With respect to methane, for example, only a 5K increase in the operating temperature from 50K increases the pressure to $1.5\times10^{-2}$ Torr. In such a vapor pressure "pegged" type of system, the heat load must therefore change drastically in order to cause a significant change in the operating temperature.

The present invention provides method and apparatus for lowering the useful operating temperature ranges of solid subliming coolers by utilizing cryogens in temperature ranges that heretofore were inaccessible or which presented impractical physical limitations on the cooling system. This object is achieved by using a radiatively-cooled vent arrangement which tends to radiate parasitic heat losses to space rather than permit them to be conducted through the walls of the vent line pipe itself into the cooler. This allows the use of cryogen coolants having significantly reduced overall mass and volume requirements.

It has now been discovered that the foregoing objectives may be accomplished, for example, by providing a horn-like, flared vent line structure (sometimes herein referred to as a "Flugelhorn") in a cooler arrangement which, in effect, combines features of a radiative cooler and a conventional solid subliming cryogen cooler. Such a radiatively-cooled vent structure allows a high heat capacity coolant (such as methane) to be used at subnormal operating temperatures, and results in a reduction in the overall size and weight of the cooler relative to conventional systems.

More particularly, it has been found that methane and similar cryogens may be used in applications requiring very low vapor pressures by forming the vent line into variously shaped radiating structures (referred to herein as a "horn") whereby an aperture in the radiator is connected to a vent aperture in the solid cryogen container. The other end of the radiator aperture is vented and radiatively directed to outer (black) space. Thus, as a practical matter, the diameter of the radiator aperture connected to the solid cryogen container can be maximized (i.e. sized as required to maintain the desired vapor pressure) since, for gaseous flow purposes, it acts essentially as an aperture in the container wall rather than as a long tube having substantial vapor flow resistance. At the same time, the outer surface of the horn (the "inside" vent tube surface which is now flared and directed outwardly to space) is capable of radiating parasitic heat losses being conducted therealong that would otherwise be conducted along the vent tube walls to the cryogen container itself. In effect, the vent line according to the invention performs the same vapor venting function as would a large diameter vent line in a conventional solid subliming coolant system, but the thermal penalty otherwise resulting from the conduction of parasitic heat losses back to the cryogen cooler through the required large diameter vent line plumbing is substantially reduced.

Because of the radiation to space of what would otherwise be parasitic heat leaks by conduction to the cryogen and the maximization of the diameter of the vent pipe at its point of connection to the cryogen container, low vapor pressure cryogens such as methane at low temperatures having inherently desirable low mass/volume characteristics are for the first time practical choices for many applications of this type of cooling system (e.g. a solid sublimation system where the working temperature is established by controlling the operating vapor pressure of the coolant material). Also, by using more suitable cryogens, it is possible to accomplish missions with significant mass reductions. Prior practice limits the equilibrium pressure of solid subliming coolers to approximately 1 Torr. This invention extends the lower end of the pressure range to roughly $10^{-4}$ Torr and extends the temperature range by a corresponding amount. This extension of temperature range frequently allows the use of a more mass efficient cryogen to meet the mission needs.

These as well as other objects and advantages of this invention will be more completely appreciated by studying the following detailed description of the presently preferred exemplary embodiment of the invention in conjunction with the accompanying drawings, of which:

FIG. 1 schematically depicts a cross-sectional view of the exemplary embodiment; and FIGS. 2–6 schematically depict other exemplary horn shapes for alternative use in the exemplary embodiment of FIG. 1.

In the drawing of FIG. 1, a radiatively-cooled vent line in accordance with the present invention is shown generally at 10. A vent line arrangement for a 50K system (based on the amount of coolant required to absorb 150 milliwatts at 50K for 5 years) has been selected for illustration purposes only. A radiatively cooled vent line member (Flugelhorn) 11 may have a horn-like configuration with outwardly-flaring edges and as FIG. 1 makes clear, the Flugelhorn may consist of an integral (one-piece) circularly symmetric construction having concentric openings at both ends. The smaller or bottom portion of the horn is attached (e.g. vacuum tight epoxy seal 9) to cooling tank 12 (containing the cryogen) at vapor vent opening 13, which has the required large diameter (typically several inches) depicted as D1. Vapor vent opening 13 thus permits a very low pressure high flow of vapor which is more typical of a mere aperture at 13 rather than the usual elongated tube vent line.

Also near the small end of Flugelhorn 11 may optionally be a thermal connection to a toroidal secondary cooler stage 30 of methane or other cryogen operating at about 75K (e.g. having a vapor pressure, for methane, of approximately 6 Torr vented conventionally through relatively small tubing 8) may be provided in thermal contact with the "inside" surfaces of the Flugelhorn via a thermally conducting ring 32. Alternatively, this secondary cooling stage may be provided by an auxiliary radiator external to the cooler. The temperature gradient through this portion of the horn is thus maintained so small that the parasitic heat leak (depicted as $Q_{c1}$ on FIG. 1) is not a serious penalty on a 50K system. The location of the point of thermal contact with ring conductor 32 is chosen to minimize total coolant requirements in accordance with standard thermal analysis techniques. (Typically, it may be located about one-fourth to one-third of the way towards the higher temperature shell 21.) For many applications the secondary cooler 30 may not even be necessary nor desirable. In that event, the residual of parasitic heat flow $Q_{c2}$ is dumped directly into the primary cooler 12 rather than secondary cooler 30.

On the warm side of the 75K thermal connection (if the secondary cooler is used), the horn flares to a large radiation surface (shown generally as 20) facing space and connects (e.g. a vacuum tight epoxy seal 7) at the periphery of its large diameter D2 to vacuum shell 21 which may be radiatively cooled to a temperature of about 120° K. The radiant heat rejecting power $Q_r$ of this part of horn 11 to space is large enough to reduce the residual of the conductive parasitic heat flow (depicted as $Q_{c2}$) which must be absorbed by the cryogen(s) to an acceptable level. In this regard, the outer radiating surface is preferably of high emissivity to maximize its radiative properties, and is shaded from warm surfaces (e.g. sun, earth, spacecraft).

The vacuum jacket 21 is cooled to roughly 120K by means of a conventional external radiator (not shown).

The horn itself is preferably made of a low thermal conductivity non-metallic material such as fiberglass-epoxy of minimum thickness for low lateral thermal conduction, and must typically structurally support one atmosphere of pressure with a safety factor for filling and ground operations. A foil metal liner (not shown) on the inside of vent horn 11 may be necessary to seal the horn against leakage into the high vacuum insulation space shown generally at 25 (e.g. multilayered aluminized Mylar and nylon net or other spacer material) surrounding the metallic (e.g. aluminum) container 12. An ejectable cover tank (not shown) containing liquid nitrogen (or other cryogen) may be used to reduce heat leakage for ground operations when the outer shell is at ambient temperature.

The method for sizing the horn and estimating its thermal performance in the exemplary system is in accordance with conventional thermodynamic analysis and is outlined in general terms for the exemplary embodiment as follows. Referring again to FIG. 1, the diameter D1 and shape of the horn must be sized to cause less than about $2\times10^{-3}$ Torr pressure drop (space pressure can be assumed to be negligible) at the steady mass flow rate, $\dot{M}$. This flow rate is based on the sum of the working heat load and all of the parasitic heat loads of the cooler. Thus, $$\dot{M} = \frac{Q\ \text{load} + Q\ \text{parasitics}}{L_s}$$

where $L_s$ is the latent heat of sublimation of the coolant.

The mass flow rate through the vent is also related to the vent characteristic as follows:

$$\dot{M}=\rho C,$$

where $\rho$ is the density of the vented gas and C is the volumetric flow characteristic or the "conductance" of the vent.

Conductance characteristics, or equations for the conductance through a vent line, are conventionally expressed in terms of the gas properties, the geometry of the vent, and depend on the nature of the flow, i.e. whether it is laminar, free molecular or in the transition range between two flow regimes. A more complete discussion of vacuum conductance appears in "Cryogenic Systems" by Randall Barron, McGraw Hill, 1966 at page 540 and is incorporated herein by reference. Generally, the conductance increases as a function of the diameter to a power greater than two and decreases linearly with the length.

The parasitic heat leak due to the horn is calculated using a network thermal model which takes into account all of the heat flow paths, material properties, geometry data and temperature profiles. The heat which reaches the 75K refrigerant (or the 50K refrigerant if a secondary cooler is not used) is greatly affected by the radiative power of the wide part of the horn and this fact is what makes the invention attractive and feasible.

The lateral heat flow along the horn is determined by classical heat conduction equations of the general form:

$$Q_c = \frac{K\,A\,\Delta T}{L}$$

where K is the temperature dependent thermal conductivity of the material; A is the geometry-dependent cross-sectional area perpendicular to the heat flow; $\Delta T$ is the temperature difference over which the heat flow takes place, and L is the geometry-dependent length of the heat flow path.

The radiant heat flow out of the horn is calculated by radiant heat transfer equations of the form:

$$Q_r=\sigma E\,A\,(T_h^4-T_c^4)$$

where $\sigma$ is the Stefan-Boltzmann constant; E is an overall emittance factor for the horn depending on the geometry and surface radiative properties; $T_h$ is the radiating surface temperature; A is the surface area of the horn facing space; $T_c$ is the temperature of space, which can be assumed to be negligible for purposes of the present invention.

It is believed that when a high capacity refrigerant (such as methane) is substituted for a low capacity refrigerant (such as nitrogen), the required mass of the cooler drops significantly because of various cumulative effects. First, the mass and volume of the coolant itself decreases, which in turn reduces the parasitic heat load on the coolant which reduces the required quantity of coolant and so on. The Flugelhorn is most effective when the space orientation is such that it almost always views black space, but this is not an absolute limitation.

Similar improved results are obtained for cases other than the above-described exemplary case. For example, nitrogen can be substituted for the less effective neon if the required temperature is near 30K; acetylene can be substituted for methane if the required temperature is near 90K; and ammonia can be substituted for carbon-dioxide at about 115K.

In this connection, Table II below lists cryogens whose minimum operating temperatures could be lowered by the Flugelhorn vent system in accordance with the present invention. Column 1 provides the expected minimum temperature utilizing conventional solid subliming cooler technology; Column 2 states the lowest temperatures achievable using radiatively-cooled vent line constructions in accordance with the present invention.

TABLE II

| Cryogen | Conventional Cooler Temp (K.) | Flugelhorn Cooler Temp (K.) |
|---|---|---|
| Hydrogen ($H_2$) | 9 | 6 |
| Neon (Ne) | 15 | 11 |
| Nitrogen ($N_2$) | 45 | 33 |
| Argon (A) | 52 | 37 |
| Methane ($CH_4$) | 64 | 45 |
| Carbon Dioxide ($CO_2$) | 135 | 100 |
| Ammonia ($NH_3$) | 150 | 120 |

Figure 3:
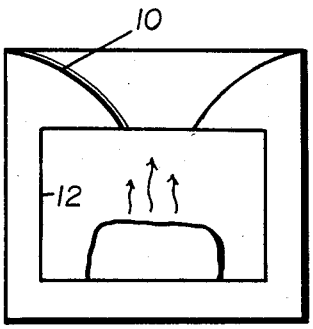
Figure 4:
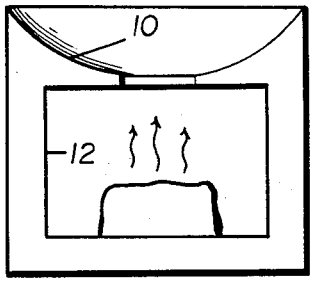
Figure 5:
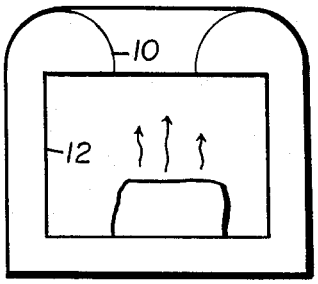
Figure 6:
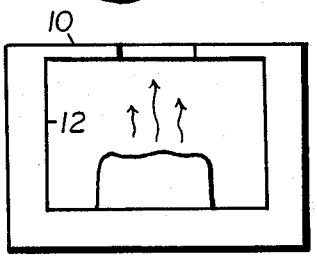

Several different configurations for the vent horn 10 may be used for specific applications. Some of these are depicted in FIGS. 2–6. The cone-shaped horn of FIG. 2 may well be the "best" configuration for many applications. The reversed spherical dish of FIG. 4, the torroidal horn of FIG. 5, the flat plate of FIG. 6 and the parabolic horn of FIG. 3 are other exemplary horn shapes.

Although one exemplary embodiment has been above-described as possibly using a secondary cooler 30, recent experiences lead us to now believe that the above-described embodiment without such a secondary cooler is one of the most viable embodiments.

While this invention has been shown and described in what is presently conceived to be the most practical and preferred embodiments, it will be apparent to those skilled in the art that many modifications and variations may be made in the exemplary embodiments while still retaining many of the novel features and advantages of this invention. Accordingly, all such modifications and variations are to be considered within the scope of the following claims.

What is claimed is:

1. A solid subliming cooler for use in space comprising:

a cryogen container having a cryogen vapor venting aperture therein;

a radiatively-cooled vent line means having a vapor flow passageway connected to said vapor venting aperture for radiating heat from an outwardly directed surface into space and away from the vent line means and away from said cooler as it is being conducted therealong towards said cryogen container; and insulation means disposed on an inwardly directed side of said vent line means, opposite said outwardly directed surface, for reducing inwardly directed heat transfer.

2. A solid subliming cooler as in claim 1 further comprising a secondary cooler in thermal contact with said vent line means and operating at a temperature higher than that of said cryogen container.

3. A solid subliming cooler as in claim 1 or 2 wherein said radiatively-cooled vent line means comprises a flared conduit made, at least in part, of a low thermal conductivity non-metallic material.

4. A solid subliming cooler as in claim 3 wherein said flared conduit is of substantially circularly symmetric shape.

5. A solid subliming cooler as in claim 3 wherein said flared conduit includes an outwardly directed high emittance surface.

6. A solid subliming cooler for use in space comprising:

a cryogen container having a cryogen vapor venting aperture therein for directly venting cryogen vapor from a solid cryogen without substantially utilizing the possible cooling capacity of the vapor itself but, rather, utilizing substantially only the cryogen's latent heat of sublimation for cooling a heat load;

a vapor venting conduit having one end connected to said vapor venting aperture to vent cryogen vapors passing therethrough from said vapor venting aperture; and said vapor venting conduit including an outwardly directed surface to form a radiant cooling means for radiating therefrom to space parasitic heat losses which would otherwise be conducted therealong towards said cryogen container.

7. A solid subliming cooler as in claim 6 wherein the outwardly directed surface of the venting conduit is flared and of high emittance to enhance its heat radiating ability, wherein the venting conduit comprises a non-metallic material; and further comprising insulation material disposed adjacent an inwardly directed surface of the venting conduit opposite said outwardly directed surface.

8. A solid subliming cooler as in claim 6 further comprising a secondary coolant system in thermal contact with said venting conduit and operating at a temperature higher than that of the cryogen in the first-mentioned cryogen container but lower than the temperature at the end of the venting conduit situated remote from said vapor venting aperture in the cryogen container.

9. A solid subliming cooler comprising:

a cryogen container having a cryogen vapor vent aperture sized for maintaining a cryogen temperature $T_1$; and a radiatively-cooled vent line having a first smaller cross-section end connected to said cryogen vapor vent aperture, having a second larger cross-section end at a higher temperature $T_2$ and being connected to vent cryogen vapors into space while radiating therefrom into space some of the parasitic heat losses otherwise flowing along the vent line from temperature $T_2$ towards temperature $T_1$.

10. A solid subliming cooler as in claim 9 further comprising a secondary coolant system operating at temperature $T_3$ intermediate temperatures $T_1$ and $T_2$ and being thermally connected to said vent line at a location between said first and second ends.

11. A solid subliming cooler as in claim 9 further comprising a methane cryogen operating at or below about $2\times10^{-3}$ Torr with $T_1$ being about 50K and $T_2$ being about 120K.

12. A solid subliming cooler as in claim 9, or 6 wherein an outwardly directed flared portion of said vent line is high emittance (darkly colored or textured) to enhance its heat radiating abilities.

13. A method of operating a solid subliming cryogen cooler, said method comprising the steps of:

subliming a predetermined solid cryogen at a predetermined vapor pressure by venting sublimed cryogen vapors from a cryogen container at a predetermined flow rate through a vent line structure;

radiating parasitic heat losses from an outwardly directed surface portion of the vent line structure as such heat losses are being conducted back towards the end of the vent line structure connected to the cryogen container thereby reducing parasitic heat losses.

14. A method as in claim 13 further comprising the steps of supplying intermediate temperature cooling to an intermediate portion of said vent line structure thereby further minimizing the flow of parasitic heat losses.

15. A radiatively-cooled venting device for a solid subliming cooler, comprising:

radiatively-cooled vent line means having an outwardly-projecting radiation surface for radiating heat therefrom as it is being conducted therealong and having a vapor flow passageway formed therein;

a first opening in said vent line means for venting vapor from said solid subliming cooler into said passageway; and a second opening in said vent line means for passing vapor from said passageway into space.

16. A radiatively-cooled venting device according to claim 15, wherein said vent line means comprises a flared tubular shell having outwardly-projecting walls.

17. A radiatively-cooled venting device according to claim 15 or 16, wherein said vent line means is flared outwardly from said first opening to said second opening which is of larger cross-sectional area than the first opening to define a horn-like configuration.

18. A radiatively-cooled venting device according to claim 15, wherein said first and second openings are circular and concentric with one another.

19. A radiatively-cooled venting device according to claim 15 or 16, wherein said vent line means comprises low thermal conductivity material.

20. A radiatively-cooled venting device according to claim 15, further comprising secondary cooling means for cooling a surface portion of said vent line means.

* * * * *